US010792717B2

(12) United States Patent
Kane et al.

(10) Patent No.: US 10,792,717 B2
(45) Date of Patent: Oct. 6, 2020

(54) BENDING DEVICE WITH ROTATING BENDING DIES

(71) Applicant: CLN OF SOUTH FLORIDA, INC., Belle Glade, FL (US)

(72) Inventors: Matthew A. Kane, Belle Glade, FL (US); David P. Kane, Belle Glade, FL (US)

(73) Assignee: CLN of South Florida, Inc., Belle Glade, FL (US)

( * ) Notice: Subject to any disclaimer, the term of this patent is extended or adjusted under 35 U.S.C. 154(b) by 246 days.

(21) Appl. No.: 15/873,647

(22) Filed: Jan. 17, 2018

(65) Prior Publication Data

US 2018/0207701 A1 Jul. 26, 2018

Related U.S. Application Data

(60) Provisional application No. 62/448,527, filed on Jan. 20, 2017.

(51) Int. Cl.

| | |
|---|---|
| ***B21D 5/08*** | (2006.01) |
| ***G09F 7/16*** | (2006.01) |
| ***B21D 11/10*** | (2006.01) |
| ***B21D 5/14*** | (2006.01) |
| ***B21D 5/04*** | (2006.01) |
| ***B21D 7/024*** | (2006.01) |
| ***B21D 11/00*** | (2006.01) |

(52) U.S. Cl.

CPC ..... *B21D 5/08* (2013.01); *B21D 5/042* (2013.01); *B21D 5/143* (2013.01); *B21D 7/024* (2013.01); *B21D 11/00* (2013.01); *B21D 11/10* (2013.01); *G09F 7/16* (2013.01)

(58) Field of Classification Search

CPC ..... B21D 5/08; B21D 5/045; B21D 5/0263; B21D 5/06; B21D 5/12; B21D 5/042; B21D 5/04; B21D 5/143; B21D 5/14; B21D 11/10; B21D 5/083; B21D 7/024; B21D 7/02; B21D 7/04; B21D 7/08; B21D 7/085; G09F 7/16

USPC ..... 72/215–317

See application file for complete search history.

(56) References Cited

U.S. PATENT DOCUMENTS 4,049,026 A * 9/1977 Del Fabro ..... B21D 11/12 140/105
6,003,358 A * 12/1999 Lipari ..... B21D 11/10 72/14.8

(Continued)

FOREIGN PATENT DOCUMENTS

CN 102862054 * 1/2013 ..... B21D 11/18
WO WO-2008029444 A1 * 3/2008 ..... B21D 5/042

OTHER PUBLICATIONS

Machine Translation of CN-102862054-A, Jianzhong et al., Publication Year 2013, pp. 12. (Year: 2019).*

(Continued)

*Primary Examiner* — Teresa M Ekiert
*Assistant Examiner* — Sarkis A Aktavoukian
(74) *Attorney, Agent, or Firm* — McHale & Slavin, P.A.

(57) ABSTRACT

The present invention is directed towards an automated bending device for bending a strip of material into a desired shape. The device is either a single or dual bending tool with interchangeable rotating bending dies which allows for a faster transition from a break bend to a radius bend using air cylinders for positioning of the tools.

12 Claims, 11 Drawing Sheets

(56) References Cited

U.S. PATENT DOCUMENTS

| | | | | |
|---|---|---|---|---|
| 6,308,551 | B1 * | 10/2001 | Park | B21D 7/022 72/217 |
| 7,387,009 | B2 | 6/2008 | Kane et al. | |
| 8,631,674 | B2 * | 1/2014 | Christofilis | B21D 7/12 72/306 |

OTHER PUBLICATIONS

Machine Translation of WO-2008029444-A, Mizukawa et al., Publication Year 2008, pp. 14. (Year: 2019).*

* cited by examiner

BENDING DEVICE WITH ROTATING BENDING DIES

PRIORITY CLAIM

In accordance with 37 C.F.R. § 1.76, a claim of priority is included in an Application Data Sheet filed concurrently herewith. Accordingly, the present invention claims priority to U.S. Provisional Patent Application No. 62/448,527, entitled "BENDING DEVICE WITH ROTATING BENDING DIES", filed Jan. 20, 2017. The contents of which the above referenced application is incorporated herein by reference.

FIELD OF THE INVENTION

This invention is directed towards an automated bending device for bending a strip of material into a desired shape; particularly towards a device having interchangeable rotating bending dies for use in forming a strip of metal into side panels to form three-dimensional letters.

BACKGROUND OF THE INVENTION

Signs are commonly used for identifying stores or other types of businesses. Often, these signs are formed from a series of discrete, three-dimensional letters. These letters, commonly known as a "channel letters," typically include congruent front and/or back panels spaced apart by a rigid spacer band extending perpendicularly between the panel perimeters. The spacer band maintains the panels in a parallel, spaced-apart orientation. With this arrangement, the letters may be fitted with an internal light source and lit from within. Usually, at least the front panel of these letters is transparent or translucent, allowing light from within the letter to pass through the front panel, thereby illuminating the letter to passersby.

Various methods have been developed to produce these letters. The front and rear panels may be formed, for example, by cutting around a template or stencil. The letter may also be stamped from large sheets of material. Corresponding spacing strips, however, are harder to produce. Conventionally, the letter panel spacing strips are formed by cutting a strip of metal sheet stock to a predetermined length appropriate for the desired letter. Then, the strip is bent at a series of key locations to produce a bounded region that will follow the contours of the selected letter. The strips also often include edge flanges that increase structural integrity. Collectively, these flanges also form surfaces that allow secure attachment of panels to the spacing strip. Additionally, the flanges may be used to secure the completed letter to a wall or other mounting surface.

U.S. Pat. No. 7,387,009, issued to Applicants, discloses an automated bending device having two opposed drive rollers that operate in conjunction with left and right side sharp ending dies. The bending device includes two different bending rollers, a sharp bend roller and a round bend roller for creating angles and curves. What is lacking is the industry is a bending device having interchangeable rotating dies, wherein a faster transition from a break bend to a radius bend is accomplished using a single tool.

SUMMARY OF THE INVENTION

The present invention relates to an automated strip-bending device used to bend a strip of metal material at a series of predetermined locations to produce the side panel found in three-dimensional signs. The automated bending device includes a table with a surface upon a single bending tool with interchangeable rotating bending dies rotatably connected thereto.

Two drive rollers along the feed path serve to maintain the strip of material in a perpendicular direction relative to the surface of the table. The rotating bending dies rotate into a sharp point position for use during a material break bend. Rotation of the bending dies to expose a rounded edge position is for use during a material radius bend.

Accordingly, it is an objective of the instant invention to disclose a device able to engender shapes on a strip of material using sharp bending dies that can be rotated to form radius bending dies.

It is a further objective of the instant invention to provide a bending device that is able to bend strips of material with a single bending tool with interchangeable rotating bending dies.

Another objective of the instant invention is to provide a bending device that eliminates the need for an additional bending tool to roll form radiuses.

Still another objective of the instant invention is to provide a bending device that can use a ¾ radius bending tool in place of larger radius bending tools, thereby allowing smaller letter formations to be formed.

Still another objective is to provide a bending device that is able to clamp material so the material does not move inside which allows for a tighter "sharper" break bend.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representative basis for teaching one skilled in the art to employ the present invention in virtually any appropriately detailed structure.

Figure 1:
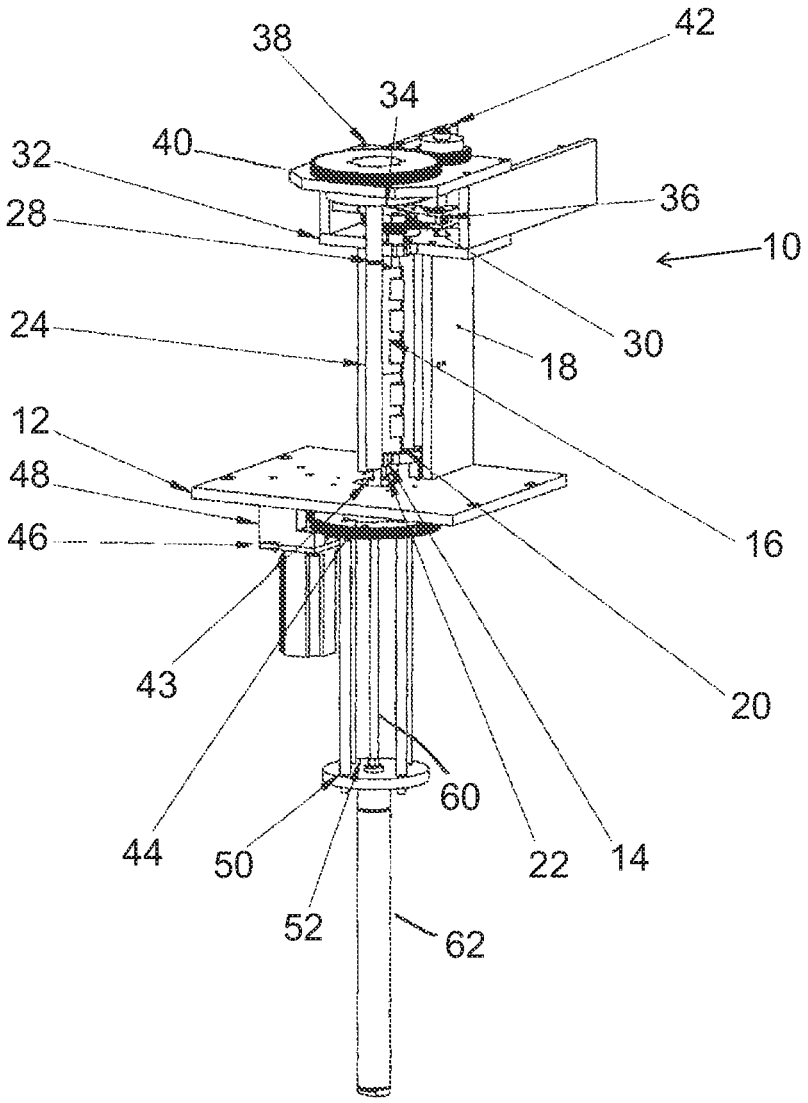
FIG. 1 is a perspective view of the automated bending device of the present invention.
Figure 3:
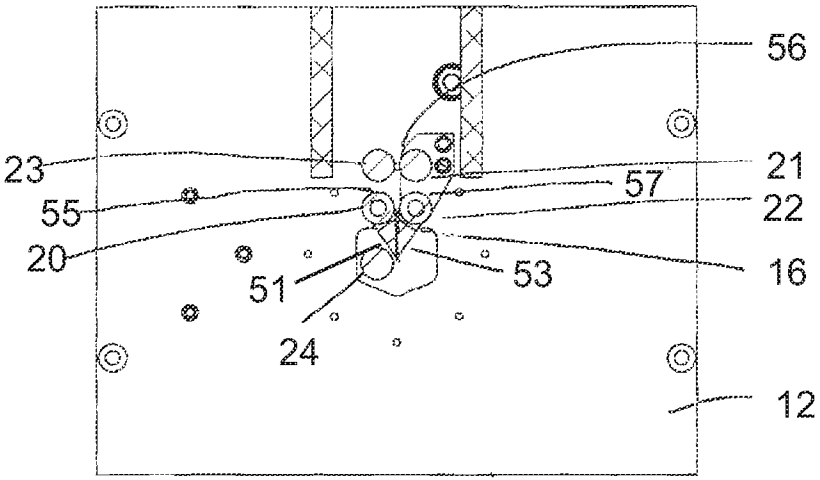
FIG. 3 is a top plane view taken along section A-A of FIG. 2.
Figure 2:
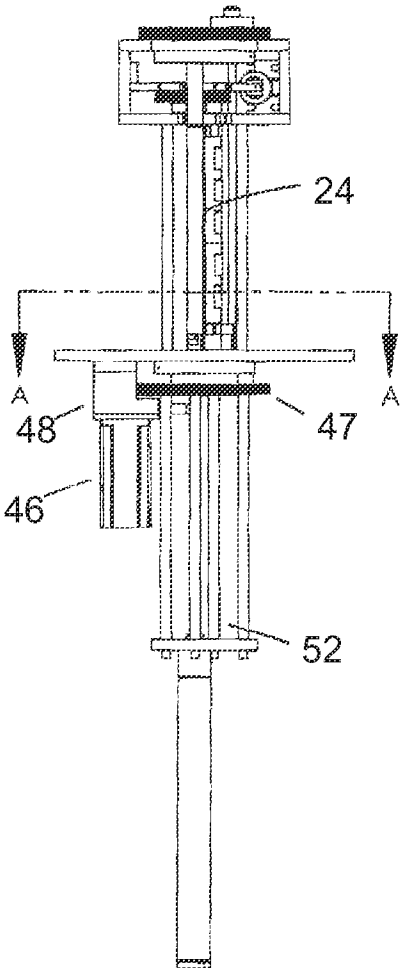
FIG. 2 is a front view of the bending dies performing a bending break.
Figure 6:
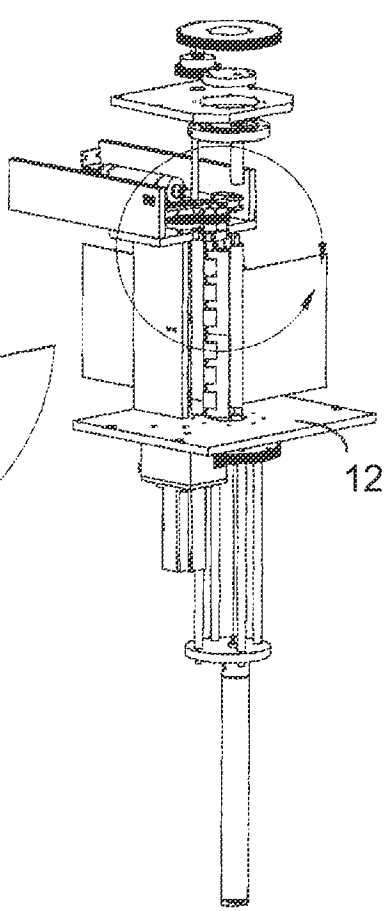
FIG. 6 is a perspective view of the automated bending device depicting a clamp position.
Figure 7:
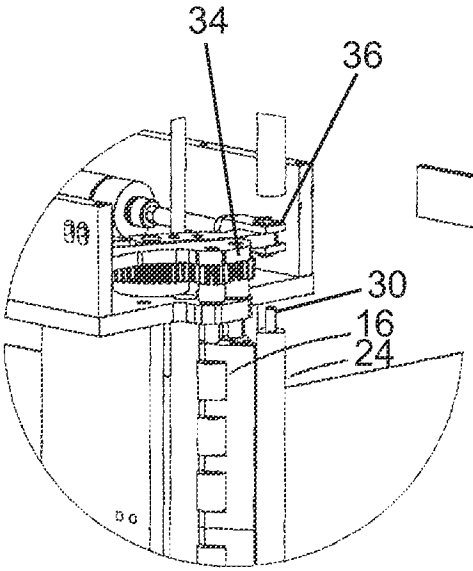
FIG. 7 is an enlarged view of FIG. 6.
Figure 5:
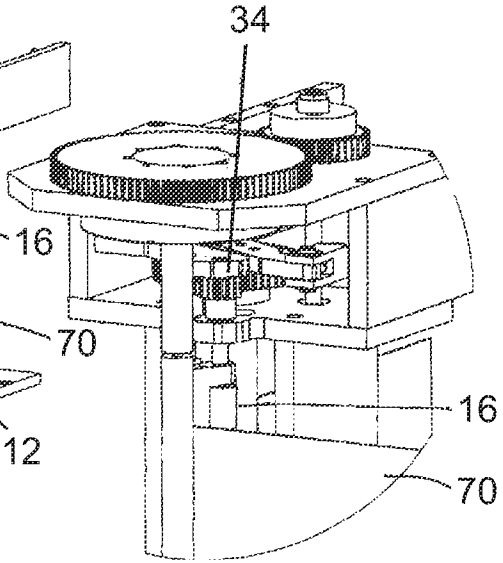
FIG. 5 is an enlarged view of FIG. 4.
Figure 4:
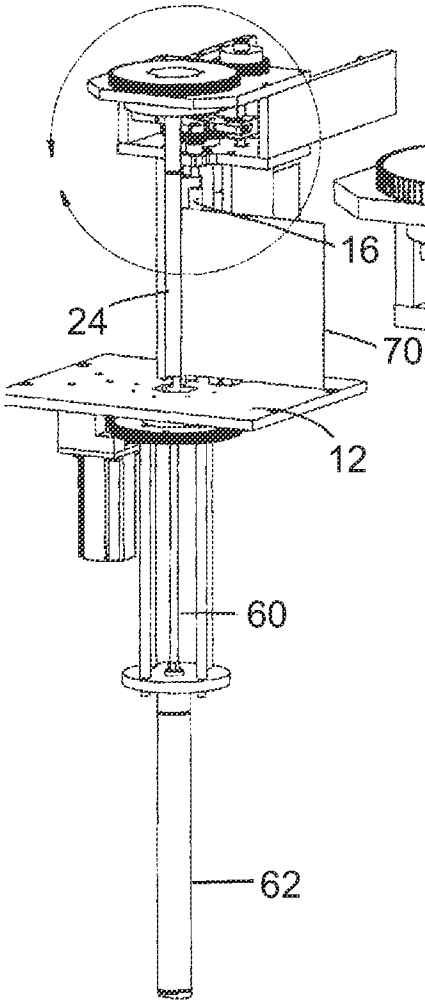
FIG. 4 is a perspective view illustrating the dies during a break bend.
Figure 9:
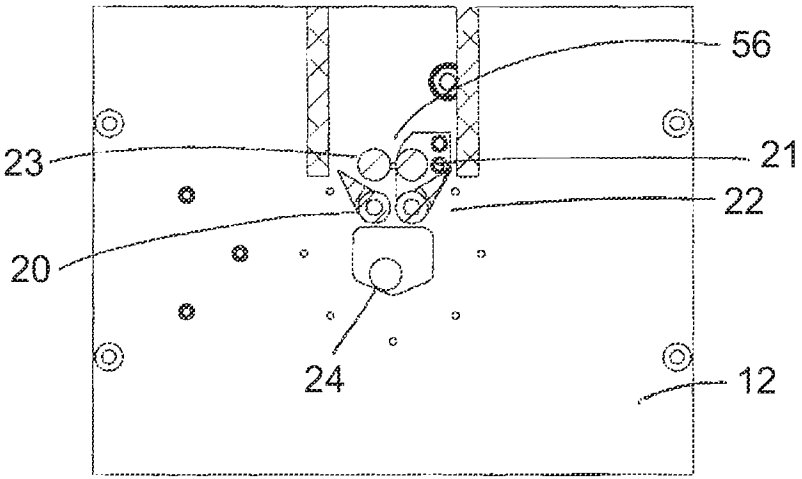
FIG. 9 is a top plane view taken along section B-B of FIG. 8.
Figure 8:
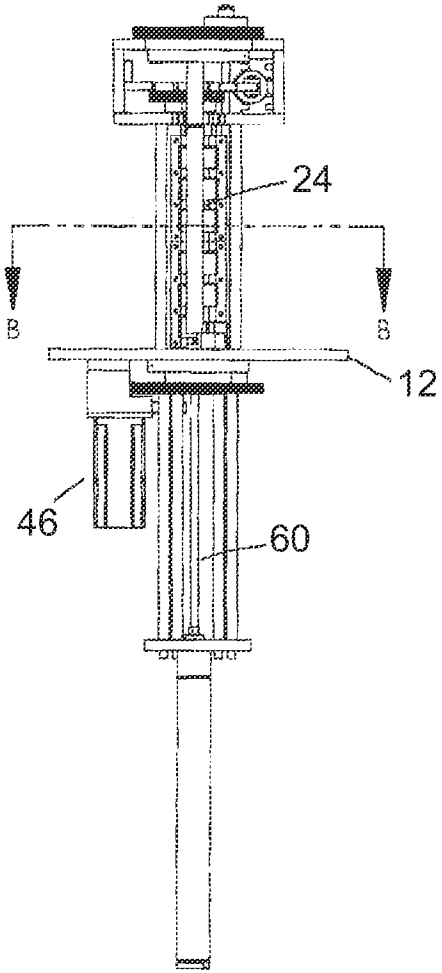
FIG. 8 is a front view thereof a radius bend.

Referring now in general to FIGS. 1-13, wherein like elements are numbered consistently throughout. FIG. 1 shows one embodiment of the bending device (10) of the instant invention. By way of an overview, the bending tool base plate (12) supports a bending tool positive die mount (14) and bending die (16). The bending device has a rear support (18) with drive rollers (21) and (23) along the feed path which serve to maintain a strip of material in a perpendicular position relative to the surface of the base plate (12). The bending ram (24) is controlled by a bending ramp top capture member (28) and bending tool pin capture member (30). A bending top sub plate (32) houses the tool clamp lever (34) and a reversing clip (36). A top gear (38) is mounted above the bending tool top riser support (40) driving a bending riser (42) regarding positioning of the bending ram (24). The bending ram capture (43) is located along the lower section of the bending ram (24). Lower gear and cylinder mount disk (44), positioned beneath the bending tool base plate (12), is rotated by a 400 watt servo motor (46) coupled to a bending tool servo mount (48). Cylinder disk extension shaft (50) and the bending tool cylinder disk (52) are positioned beneath the tool base plate (12). The bending ram (24) is placed in position by a push rod (60) that is driven by an air cylinder (62).

Referring to FIGS. 2-6, depicted is an illustration of a bending ram position and a clamp position. The bending die (16) serves as both a means to guide a strip of material (70) along a feed path (56) and a contact surface formed by the upper surface of the tool base plate (12) the bending assembly acts to produce a "sharp" bend in the material using guide rollers (21, 23) to control movement of the material (70). The bending assembly includes the rotating die assembly, upon which a sharp bending radius can be made by rotation of the bending dies (20) and (22) from a sharp end point (51, 53) to a roller radius end (55, 57). The assembly further comprises a lower rotating head portion (47) that is, in turn, connected to the reversible stepper 400 watt servo motor (46) by any means known in the art, (i.e. gears, belts, etc). The lower rotating head portion is affixed underneath the plate (12), such that it remains beneath the surface of the table, preferably within an enclosed housing so as to avoid contact with the operator of the device. The lower rotating head portion (47) is herein illustrated as a rotating circular platform upon which the bending ram (24) is positioned in an "upper position", that is, above the table surface for placement into the feed path of the strip of material for bending. The cylinder disk (52) provides a fixed platform upon which the bending ram (24) resides when in the "lowered" position beneath the table.

When a sharp corner is desired on the strip of material, the bending ram actuator air cylinder (62) lifts the bending ram (24) into position using push rod (60) and consequently places it into the upper position on the rotating platform. The combination of the bending ram (24) positioning and the dies (20) and (22) permit the sharp and round bending rollers to be positioned wherein the material can be bent from the left or right side while it is conveyed down the feed path.

In operation, the design information regarding the desired shape of the material strip is input into a computer. The computer's software uses information obtained from at least one position sensor and the design information, and transforms this information into signals that are used to control the speed and timing of all the various devices according to the design instructions, for example, the speed of the servo motor and the drive rollers, positioning of the bending dies, and placement of the bending ram.

Figure 11:
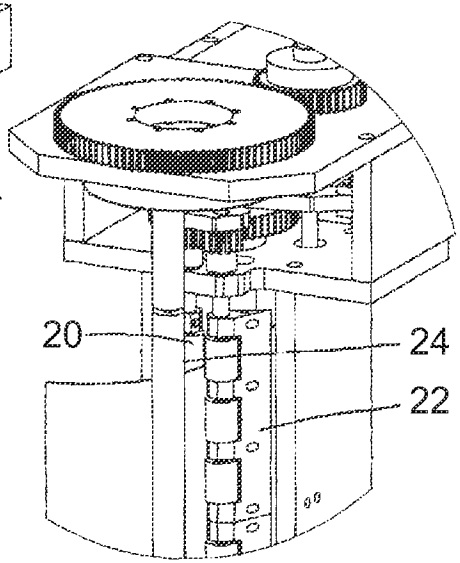
FIG. 11 is an enlarged view of FIG. 10.
Figure 10:
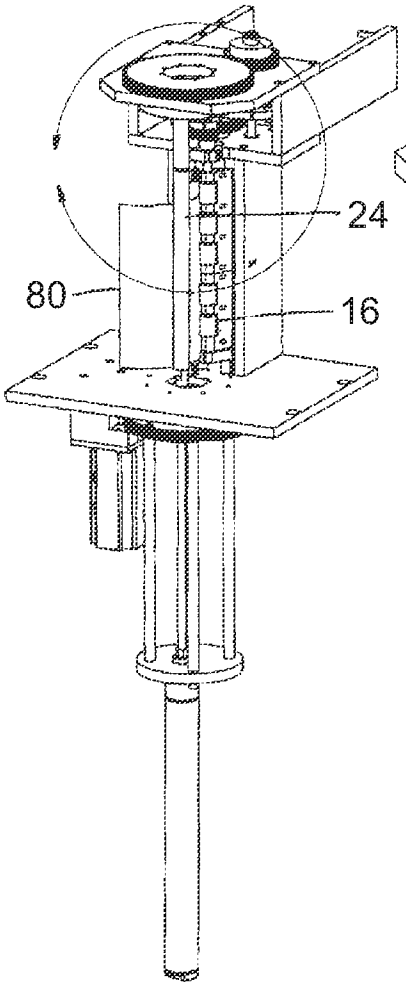
FIG. 10 is a perspective view illustrating the dies during a radius bend.
Figure 14:
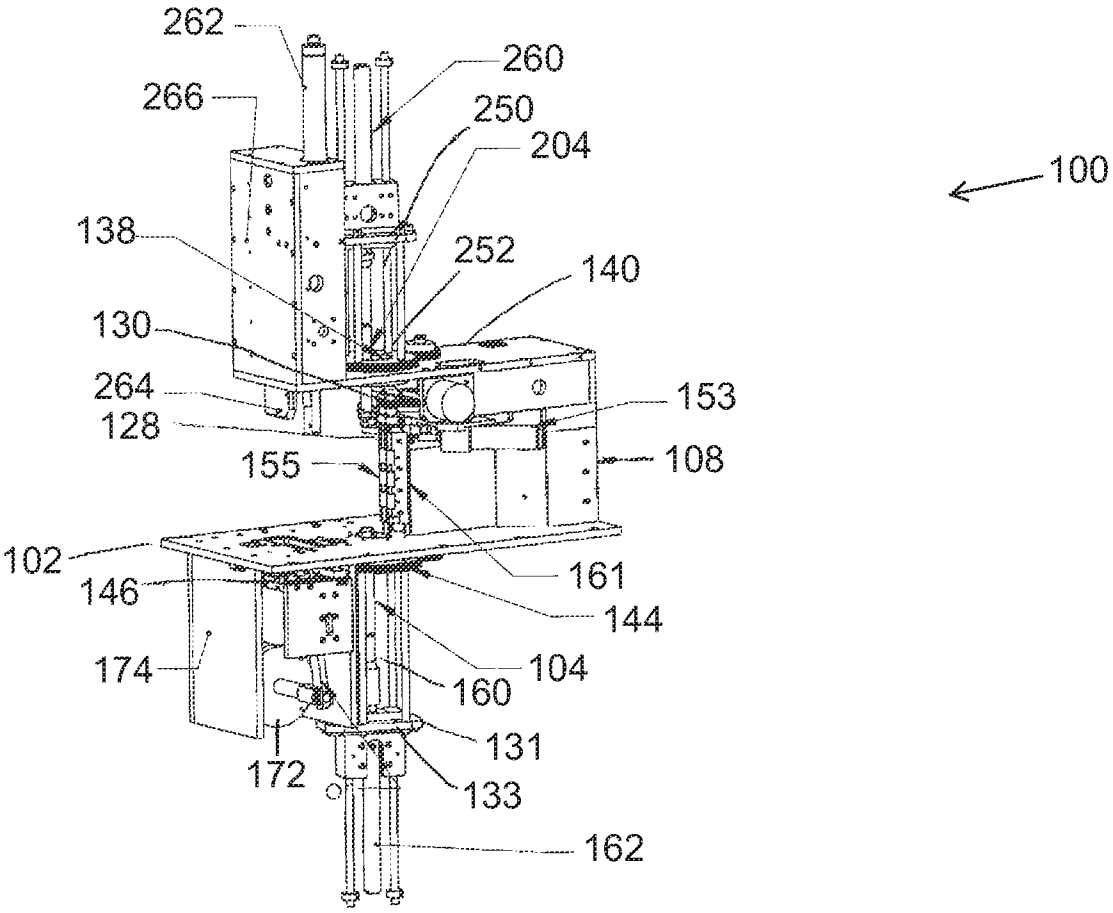
FIG. 14 is a perspective view of two cylinder bending tool of the present invention.

The rotating die in this device is interchangeable, which eliminates the need for a second bending tool and to roll form radiuses, as generally illustrated in FIGS. 8-13. When a bending radius is desired, the bending ram (24) is retracted beneath the base plate (12). The dies (20) and (22) are rotated as illustrated, providing a radius corner, as opposed to the sharp corner. As illustrated in FIGS. 10 & 11, a sheet of material (80) is fed through left and right dies (20) and (22), wherein the bending ram (24) is used in combination with the left die (20) for bending the material into the desired shape. A reverse formation shape would be obtained by retracting the bending ram (24) and forwarding the material incrementally, wherein the bending ram (24) can be repositioned on the opposite side of the material (80). The bending ram (24) would then operate in combination with the right die (22) as the material 80 is fed through the dies to provide a reverse radius bend. In this configuration, the dies (20) and (22) are used to provide a radius.

Figure 12:
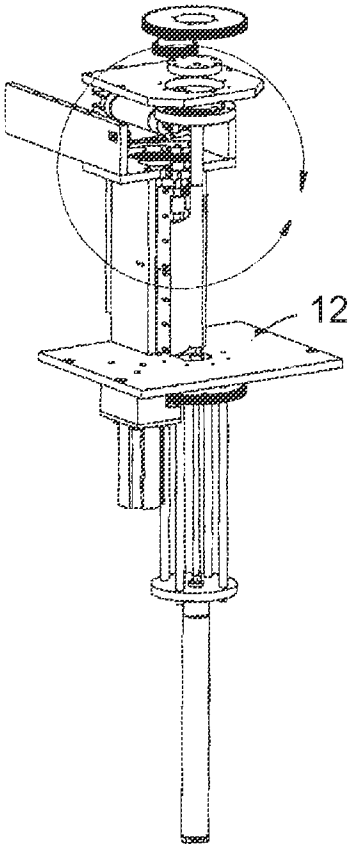
FIG. 12 is a perspective view illustrating the bending die position while performing a radius bend.
Figure 13:
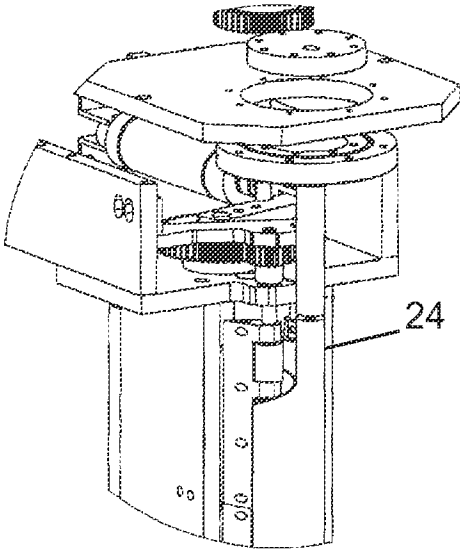
FIG. 13 is an enlarged view of FIG. 12.

The illustration in FIGS. 12 and 13 depicts a clamp position. The combination of the bending ram (24) positioning and the dies (20) and (22) permit the radius bending in either direction by proper placement of the bending ram (24). This allows a single bending tool to be used with rotating bending dies to provide a faster transition from a break bend to a radius bend. Further, this allows radius shapes to be made without the need for a second bending tool.

Referring now in general to FIGS. 14-24, set forth is another embodiment of the instant invention using a dual air cylinder bending device (100). The bending tool device has a base plate (102) that supports a bending tool (104) for negative bends and a bending tool (204) for positive bends. The bending device (100) has a rear support (108) with guide rollers (121) and (123) which feed sheet material along a feed path and serve to maintain the material in a perpendicular position relative to the surface of the base plate (102). A bending ram (124) is controlled by a bending ramp top capture member (128) and bending tool pin capture member (130). A top gear (138) is mounted above a bending tool top riser support used for driving the bending tool (104). A bending ram capture (143) is located along the lower section of the bending ram (124) for holding material about the radius bending rollers 155. The bending ram support arm 156, 158 has a clamp reinforcement air cylinder (153) to secure a material in position. A lower gear and cylinder mount disk (144) is positioned beneath the bending tool base plate (102), and is rotated by servo motor (146) coupled to a bending tool servo mount. Cylinder disk extension shaft (131) and the bending tool cylinder disk (133) are positioned beneath the tool base plate (102) to provide a tool for negative bends. The bending tool (104) is placed in position by a push rod (160) that is driven by an air cylinder (162). A material shear actuator (172) is positioned within a housing (174).

The bending tool device (100) further supports a bending tool (204) for positive bends. The bending device (100) employs the rear support (108) with guide rollers (121) and (123), which feed the material into rollers (120) and (122) along a feed path which serve to maintain a strip of material in a perpendicular position relative to the surface of the base plate (102). Cylinder disk extension shaft (250) and the bending tool cylinder disk (252) are positioned above the tool base plate (102) to provide a tool for positive bends. The bending tool (204) is placed in position by a push rod that is driven by an air cylinder (260). A material shear actuator (262) is positioned within a protective housing (266). The bending ram (124) is controlled by a bending ramp top capture member (128) and bending tool pin capture member (130). An upper gear (138) is mounted above a bending tool top riser support used for driving the bending tool (204). A bending ram capture (143) is located along the lower section of the bending ram (124) for holding material about the radius bending rollers (154A) and (154B). The bending ram (124) has a clamp reinforcement air cylinder (153) to secure a material in position. A lower gear and cylinder mount disk (144) is positioned beneath the bending tool base plate (102), and is rotated by the servo motor (146) coupled to a bending tool servo mount.

Figure 16:
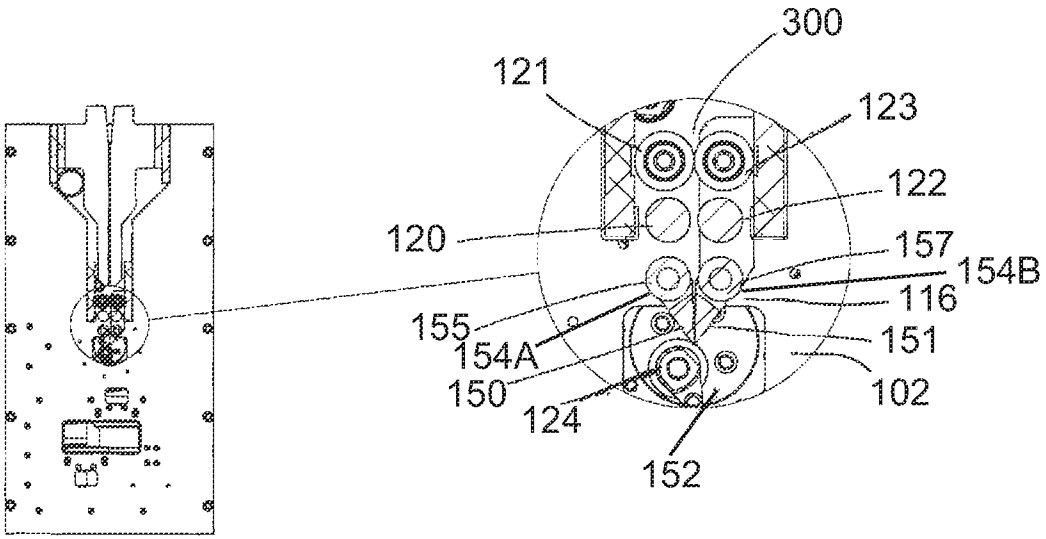
FIG. 16 is a top plane view taken along section A-A of FIG. 15.
Figure 15:
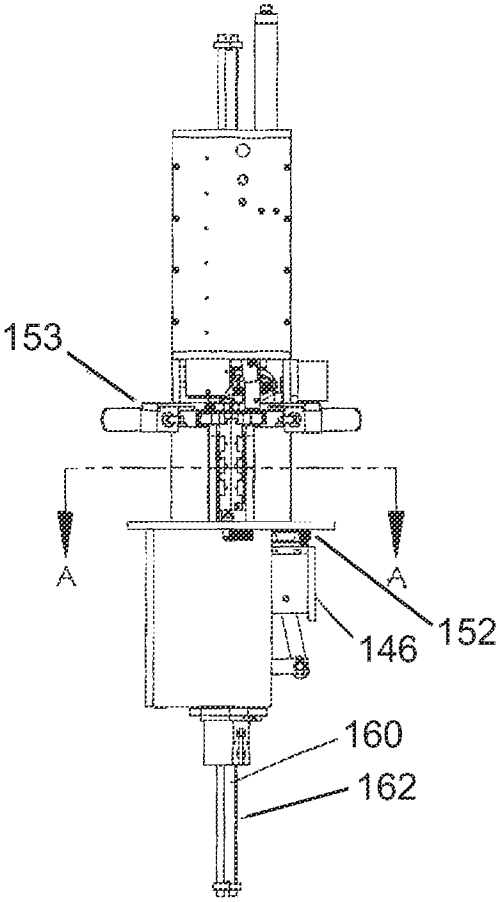
FIG. 15 is a front view of the bending dies performing a bending break.

Referring to FIGS. 15-16, depicted is an illustration of a bending ram position and a clamp position. The bending die (116) serves as both a means to guide a strip of material (70) along a feed path (300) and a contact surface formed by the upper surface of the tool base plate (102), the bending assembly acts to produce a "sharp" bend in the material using drive rollers (121, 123) to control movement of the material. The bending assembly includes the rotating die assembly, upon which a sharp bending radius can be made by rotation of the bending dies (154A) and (154E, from a sharp end point (150, 151) to a roller radius end (155, 157). The bending assembly is coupled to a lower rotating head portion (147) that is, in turn, connected to the reversible servo motor (146) by any means known in the art, (i.e. gears, belts, etc.). The lower rotating head portion is affixed underneath the plate (102), such that it remains beneath the surface of the table, preferably within an enclosed housing so as to avoid contact with the operator of the device. The lower rotating head portion (147) is herein illustrated as a rotating circular platform upon which the bending ram (124) is positioned in an "upper position", that is, above the table surface for placement into the feed path of the strip of material for bending. The cylinder disk (152) provides a fixed platform upon which the bending ram (124) resides when in the "lowered" position beneath the table.

When a sharp corner is desired on the strip of material, the bending ram actuator air cylinder (162) lifts the bending ram (124) into position using push rod (160) and consequently places it into the upper position on the rotating platform. The combination of the bending ram (124) positioning and the dies (154A) and (154E, permit the sharp and round bending rollers to be positioned wherein the material can be bent from the left or right side while it is conveyed down the feed path.

In operation, the design information regarding the desired shape of the material strip is input into a computer. The computer's software uses information obtained from at least one position sensor and the design information, and transforms this information into signals that are used to control the speed and timing of all the various devices according to the design instructions, for example, the speed of the stepper motor and the drive rollers, positioning of the bending dies, and placement of the bending ram.

Figure 18:
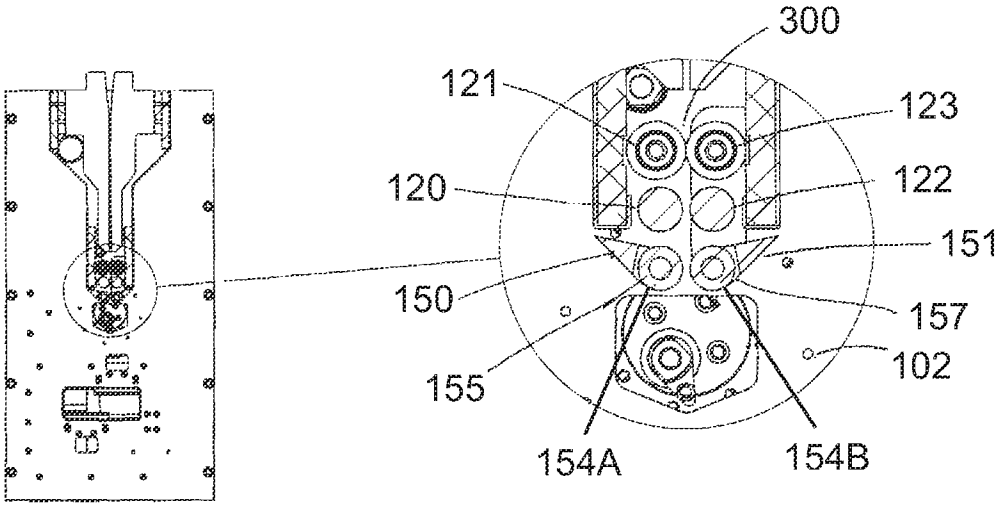
FIG. 18 is a top plane view taken along section A-A of FIG. 15.
Figure 17:
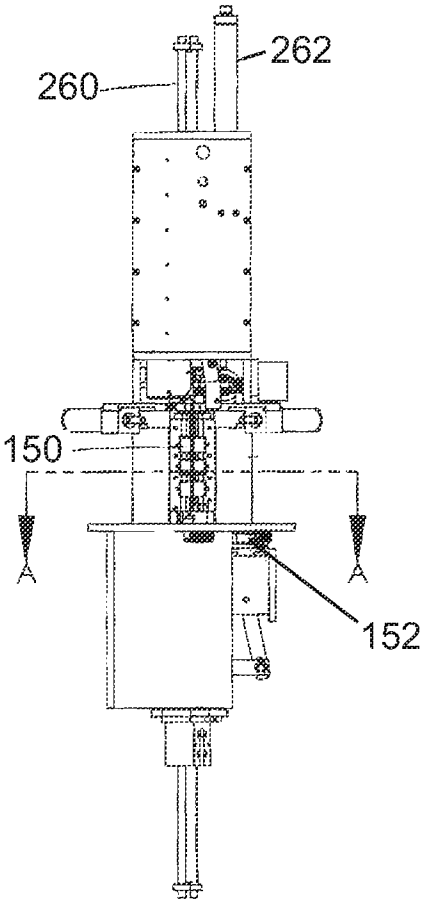
FIG. 17 is a front view of the bending dies performing a radius bend.

As depicted in FIGS. 17 and 18, when a bending radius is desired, the bending ram (124) is retracted beneath the base plate (102). The dies (154A) and (154E, are rotated as illustrated, providing a radius corner, as opposed to the sharp corner. Material is fed through left and right dies guide rolls (120) and (122), wherein the bending ram (124) is used in combination with the left die (154A) for bending the material into the desired shape. A reverse formation shape would be obtained by retracting the bending ram (124) and forwarding the material incrementally, wherein the bending ram (124) can be repositioned on the opposite side of the material. The bending ram (124) would then operate in combination with the right die (154E, as the material is fed through the dies to provide a reverse radius bend. In this configuration, the guide rolls (120) and (122) are used to provide a radius bend. FIG. 18 also illustrates another pair of guide rollers 163, 165.

Figure 20:
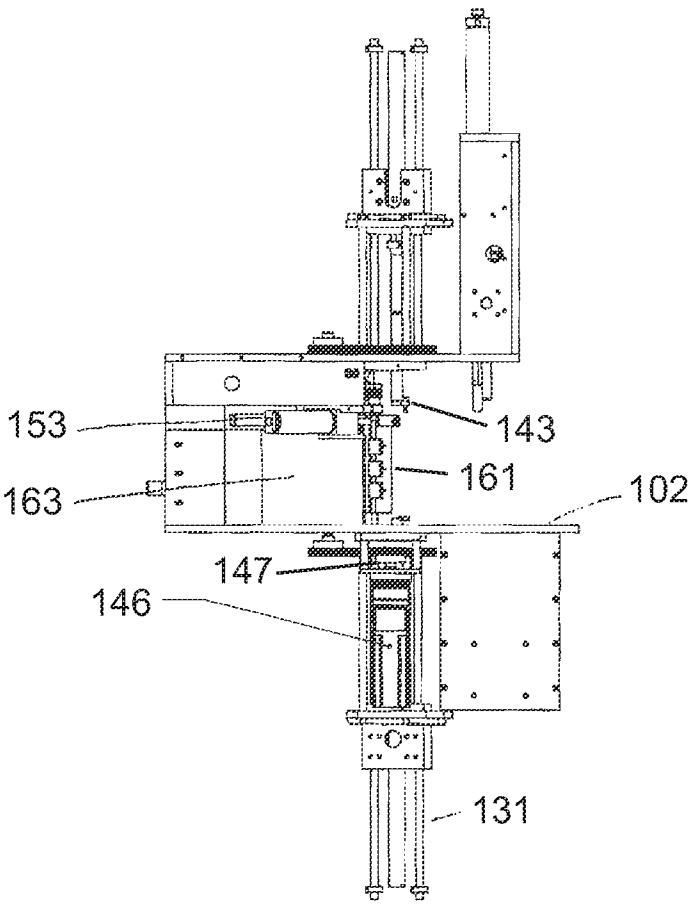
FIG. 20 is a left side view of the bending tool.
Figure 19:
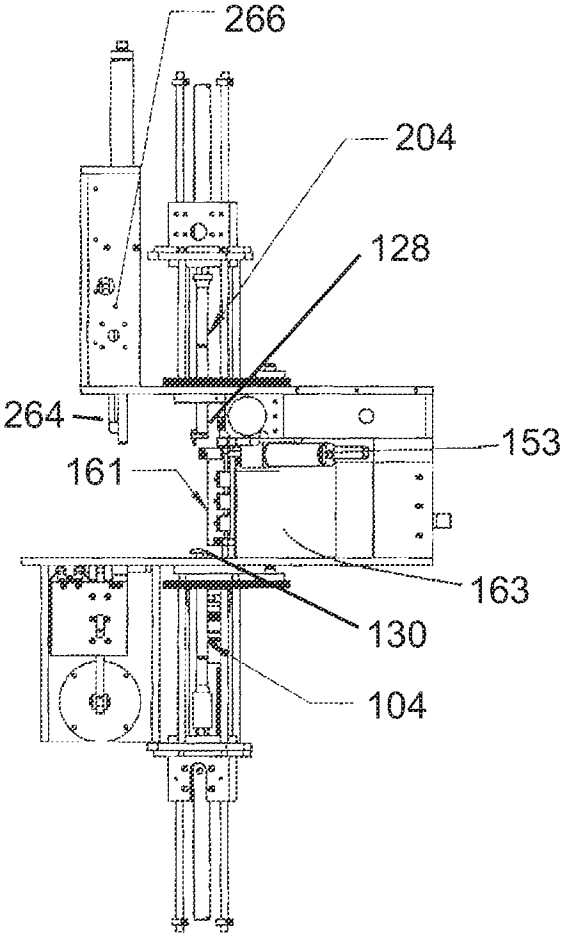
FIG. 19 is a right side view of the bending tool.

FIG. 19 is a right side view of the bending tool (100) depicting the bending tool (204) for positive bends positioned about the platform (102) and the bending tool (104) for negative bends positioned beneath the platform (102). The roller radius ends 155, 157 operate in combination with the bending die clamp 161. The material shear housing (266) controlling the material shear (264) positioned about the platform (102). FIG. 20 is a left side view of the bending tool (100) further illustrating the bending die clamp 161 right side portion, and the right side clamp reinforcement air cylinder (153). The bending tool motor (146) is positioned beneath the platform (102). FIGS. 19 and 20 also show deflector plates 163.

Figure 21:
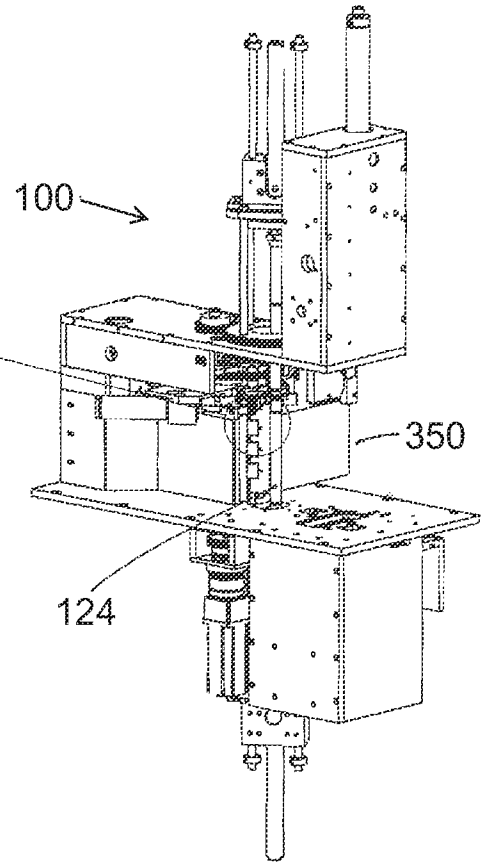
FIG. 21 is a perspective view of the automated bending device illustrating a break bend clamp position.
Figure 22:
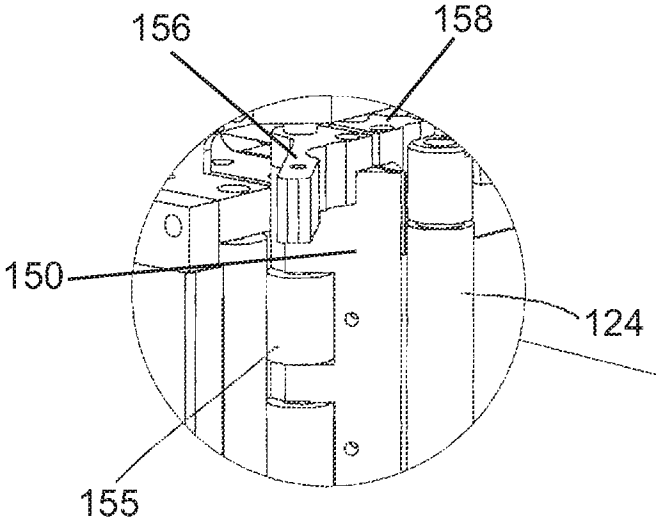
FIG. 22 is an enlarged view of FIG. 21.
Figure 23:
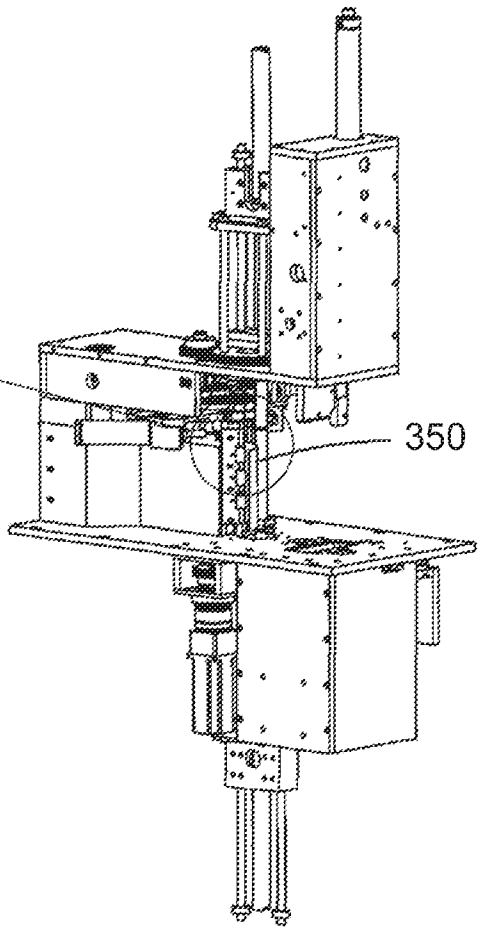
FIG. 23 is a perspective view of the automated bending device illustrating a radius bend clamp position.
Figure 24:
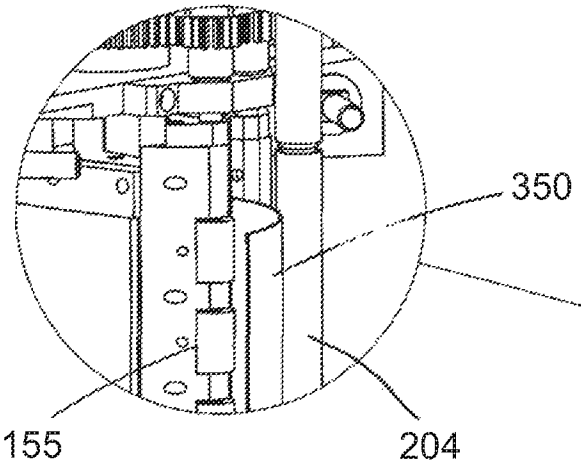
FIG. 24 is an enlarged view of FIG. 23.

FIG. 21-22 illustrates the automated bending device (100) in a break bend clamp position wherein the material (350) is clamped and the bending tool (124) forms the material (350) around the sharp bend die 150 providing a break bend. FIGS. 23-24 illustrates the automated bending device (100) in a radius bend clamp position wherein the material (350) is clamped (124) and the bending tool (204) forms the material (350) around the radius bending rollers roller radius end 155 or 157 providing a radius bend.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims.

What is claimed is:

1. A channel letter bending device for bending a strip of metal material at predetermined locations as said strip of metal material is continuously fed though said device, said device comprising:

a base plate having a surface upon which at least two opposed drive rollers are rotatably connected thereto, said drive rollers are constructed and arranged to drive said strip of metal material along a feed path;

a pair of rotating bending dies, each said die having a first end defining a circular diameter and a second end configured with side walls ending in a sharp point;

a first bending ram secured to a rotating assembly, said first bending ram constructed and arranged to independently position the strip of metal material on either side of and across said feed path for creating at least one radius when one said die of said pair of rotating bending dies is rotated to engage the first end of one said die of said pair of rotating bending dies or a sharp angle when one said die of said pair of rotating bending dies is rotated to engage the second end at predetermined locations along said strip of metal material.

2. The channel letter bending device according to claim 1 wherein said first bending ram is stored in a first position beneath said base plate surface and raised into a second position with an air cylinder.

3. The channel letter bending device according to claim 1 wherein said first bending ram has a diameter of about ¾ inch.

4. The channel letter bending device according to claim 1 wherein said bending dies are constructed and arranged to clamp the strip of metal material.

5. The channel letter bending device according to claim 1 wherein said pair of opposing drive rollers are positioned along a feed path, said drive rollers maintaining the strip of metal material in a perpendicular direction relative to the base plate surface.

6. The channel letter bending device according to claim 1 including a second bending ram secured to said rotating assembly, said second bending ram constructed and arranged to independently position the strip of metal material on either side of and across said feed path for creating at least one radius when one said die of said pair of rotating bending dies is rotated to engage the first end of one said die of said pair of rotating bending dies or a sharp angle when one said die of said pair of rotating bending dies is rotated to engage the second end at said predetermined locations along said strip of metal material, wherein said first bending ram is for negative bends and second bending ram is for positive bends.

7. The channel letter bending device according to claim 6 wherein said second bending ram is stored in a first position above said base plate surface and lowered into second position with an air cylinder.

8. The channel letter bending device according to claim 1 comprising a plurality of said opposing drive rollers positioned along said feed path, said plurality of opposing drive rollers maintaining the strip of metal material in a perpendicular direction relative to the base plate surface.

9. A channel letter bending device for bending a strip of metal material at predetermined locations as said strip of metal material is continuously fed though said device, said device comprising:

a base plate having a surface upon which at least two opposed drive rollers are rotatably connected thereto, said drive rollers are constructed and arranged to drive said strip of metal material along a feed path;

a pair of rotating bending dies, each said die have a first end defining a circular diameter and a second end configured with side walls ending in a sharp point;

a first bending ram for negative bends secured to a rotating assembly, said first bending ram constructed and arranged to independently position the strip of metal material on either side of and across said feed path for creating at least one radius when one said die of said pair of rotating bending dies is rotated to engage the first end of one said die of said pair of rotating bending dies or a sharp angle when one said die of said pair of rotating bending dies is rotated to engage the second end at said predetermined locations along said strip of metal material, said first bending ram stored in a position beneath said base plate surface and raised into an operating position with a first air cylinder; and a second bending ram for positive bends secured to said rotating assembly, said second bending ram constructed and arranged to independently position the strip of metal material on either side of and across said feed path for creating at least one radius when one said die of said pair of rotating bending dies is rotated to engage the first end of one said die of said pair of rotating bending dies or a sharp angle when one said die of said pair of rotating bending dies is rotated to engage the second end at predetermined locations along said strip of metal material, said second bending ram stored in a position above said base plate surface and lowered into an operating position with a second air cylinder.

10. The channel letter bending device according to claim 9 wherein each said bending ram has a diameter of about ¾ inch.

11. The channel letter bending device according to claim 9 wherein said bending dies are constructed and arranged to clamp the strip of metal material.

12. A channel letter bending device for bending a strip of material at predetermined locations as said strip of material is continuously fed though said device, said device comprising:

a base plate having a surface upon which at least two opposed drive rollers are rotatably connected thereto, said drive rollers are constructed and arranged to drive said strip of material along a feed path;

a pair of rotating bending dies, each said die have a first end defining a circular diameter and a second end configured with side walls ending in a sharp point;

a first bending ram secured to a rotating assembly, said first bending ram constructed and arranged to independently position the strip of material on either side of and across said feed path for creating at least one radius when one said die of said pair of rotating bending dies is rotated to engage the first end of one said die of said pair of rotating bending dies or a sharp angle when one said die of said pair of rotating bending dies is rotated to engage the second end at said predetermined locations along said strip of material.

* * * * *